United States Patent [19]

Burns

[11] Patent Number: 5,058,298

[45] Date of Patent: Oct. 22, 1991

[54] REAR-LOADED PICTURE FRAME SIDE MEMBER

[76] Inventor: William Burns, 14 Mill Lane, North Reddish, Stockport SK5 GUU, England

[21] Appl. No.: 444,722

[22] Filed: Dec. 1, 1989

[30] Foreign Application Priority Data

Dec. 21, 1988 [GB] United Kingdom ..... 8829785

[51] Int. Cl.[5] ..... G09F 1/12; A47G 1/06

[52] U.S. Cl. ..... 40/156; 40/152

[58] Field of Search ..... 40/152, 152.1, 154, 40/156, 647

[56] References Cited

U.S. PATENT DOCUMENTS

| | | | |
|---|---|---|---|
| 667,640 | 2/1901 | Sweeney | 40/156 |
| 3,200,526 | 8/1965 | Munn | 40/152 |
| 3,283,431 | 11/1966 | Pearlman | 40/152 |
| 3,668,799 | 6/1972 | Sharron | 40/152.1 |
| 4,204,350 | 5/1980 | Brenner | 40/156 |
| 4,835,891 | 6/1989 | Joffe | 40/156 |

FOREIGN PATENT DOCUMENTS

| | | | |
|---|---|---|---|
| 2127686 | 4/1984 | United Kingdom | 40/152 |

*Primary Examiner*—Gary L. Smith
*Assistant Examiner*—F. Saether
*Attorney, Agent, or Firm*—Charles J. Brown

[57] ABSTRACT

There is disclosed a picture frame comprising a plurality of rebated side frame members at least one of which is provided with a part hingedly connected thereto, and movable between a first position in which it lies outside the rebate and a second position in which it lies within the rebate to engage the rear face of a backing sheet or board, and urge same towards the front of the frame.

1 Claim, 2 Drawing Sheets

REAR-LOADED PICTURE FRAME SIDE MEMBER

This invention concerns a picture frame.

When framing a picture it is first necessary to construct or select a frame of suitable size. A sheet of glass, possibly one or more borders, the picture and a backing sheet or board are then assembled within the rebate of the frame and the backing sheet or board is then secured to the frame to hold the assembly firmly in place.

Various methods for securing the backing are known and include the use of pins or adhesives. Such methods are very time consuming, and, whilst acceptable for a custom-built frame, are generally unsuited to mass production.

Other methods include the use of clips of various kinds. These generally rely on the total thickness of materials within the rebate to hold such firmly together, with the result that if such thickness is less than expected some relative movement between the assembled components may be possible with attendant disadvantages such as rattling glass, movement of the picture from centre and ingress of dust.

It is an object of the present invention to provide a picture frame which overcomes the problems aforesaid.

According to the present invention there is provided a picture frame comprising a plurality of rebated side frame members at least one of which is provided with a part hingedly connected thereto, and movable between a first position in which it lies outside the rebate and a second position in which it lies within the rebate to engage the rear face of a backing sheet or board, and urge the same towards the front of the frame.

The part may be a flap which extends over substantially the whole of the length of the frame member to which it is connected or of short length in the form of a tab.

There may ba two or more spaced tabs along the length of a frame member.

The flap may be integral with the frame member and the two may be formed from a plastics material by a moulding or extrusion technique.

The plastcis material may be polypropylene.

The flaps or tabs may be hingedly connected with support strips which are secured to the rear of the frame members by adhesive or pins.

The free edge of the flap remote from the hinge connection may be profiled so as to be resiliently deformable or compressible against the rear face of the backing.

The entire frame may be formed as an integral plastics moulding or the frame may be assembled from mitred lengths of extrusion.

The invention will be further apparent from the following description with reference to the figures of the accompanying drawing which show, by way of example only, three forms of picture frame embodying same.

Figure 1:
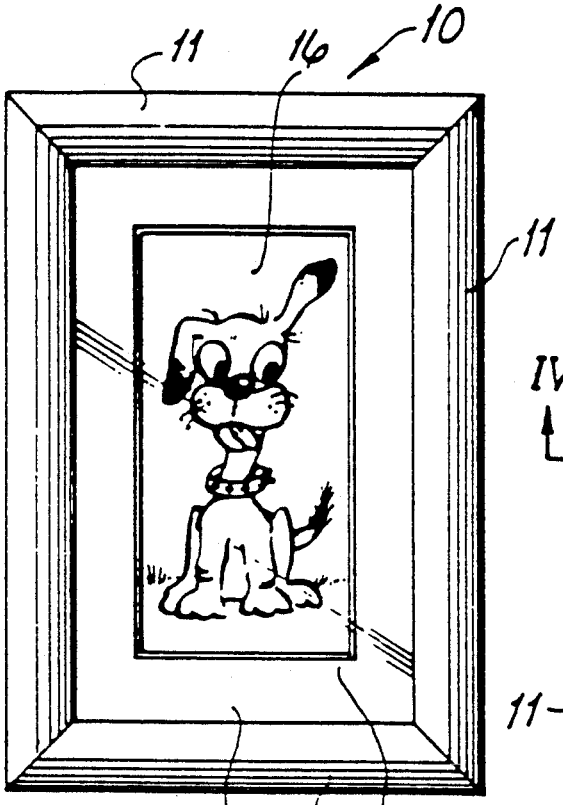
FIG. 1 shows a front elevation of the first form of frame.

Referring now to FIGS. 1-4 of the drawings, it will be seen that the first form of picture frame 10 comprises four side frame members 11 joined at the corners of the frame in a known manner. Each of the frame members 11 is rebated at 12 whereby the rear of the frame defines a recess to receive a sheet of glass 14, a border 15, a picture 16 and backing board 17.

Each of the frame members 11 is provided with a flap 18 hingedly connected thereto and movable from a first position (FIG. 3) in which it lies outside the rebate 12 to enable installation of the parts 14 to 17 inclusive and a second position (FIG. 4) in which it is folded downwardly into the rebate 12 to engage the rear face of the backing board 17.

Figure 3:
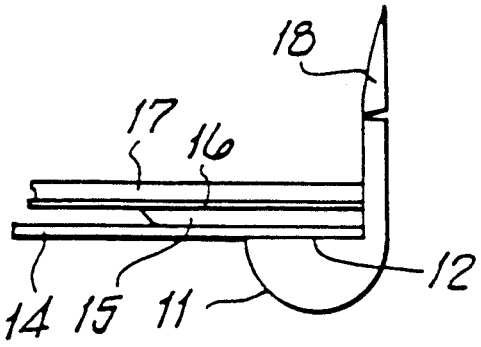
FIG. 3 shows a cross-section through the frame on the line III - III of FIG. 2.

The free edge of the flap 18 is profiled (as best seen in FIG. 3) so as to be resiliently deformable against the board 17 when in its second position so as to urge the board 17 towards the front of the frame to clamp all of the parts firmly together.

Figure 2:
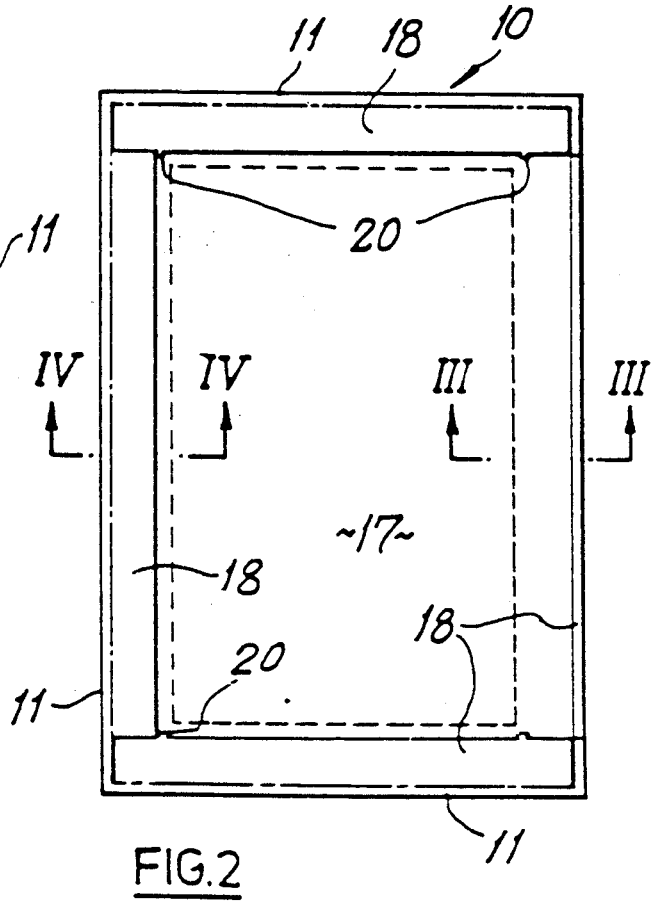
FIG. 2 shows a rear elevation of the frame of FIG. 1.
Figure 4:
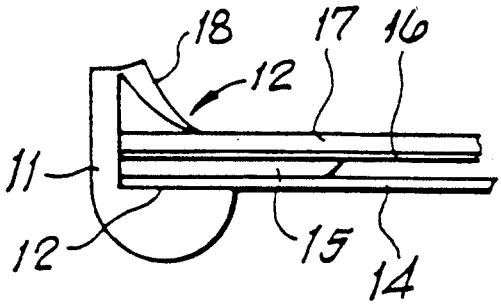
FIG. 4 shows a cross-section through the frame on the line IV - IV of FIG. 2.

As seen in FIG. 2 the flaps 18 to the upper and lower frame members 11 extend the full length of the rebates thereof whereas those to the side frame members 11 are spaced inwardly of each end of the rebate by the thickness of the flaps 18. In this way all four flaps may be folded into the rebate, the upper and lower flaps first, followed by the side flaps. The side flaps hold the upper and lower flaps against displacement and the side flaps can be latched into position behind small nibs 20 on the faces of the upper and lower flaps.

The entire frame as described may be an integral moulding of a suitable plastics material such as a polypropylene for example, the hinges between the members 11 and flaps 18 being thin bridges connecting the two parts.

In an alternative the frame may be fabricated from mitred lengths of a plastics extrusion.

Figure 5:
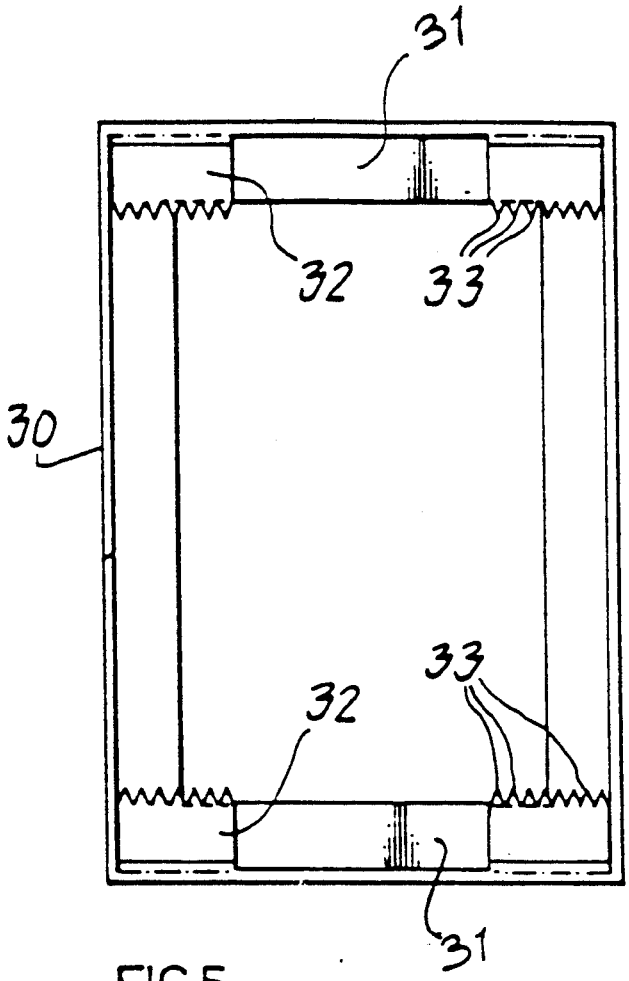
FIG. 5 shows a rear elevation of the second form of frame.

In either event, the act of framing a picture is simplicity itself, all of the parts being secured simply by folding the four flaps inwardly in turn Referring now to FIG. 5, it will be seen that in the second form of frame 30 the extended flaps are replaced by a pair of spaced tabs 32 at opposite ends of the upper and lower frame members 31. The tabs have a sawtooth formation 33 on their free edges remote from their hinged connection with the frame members 31, which provides a firm grip on the rear face of the backing board when the tabs are operatively folded into the rebate.

Again this frame is formed as an integral plastics moulding.

Figure 6:
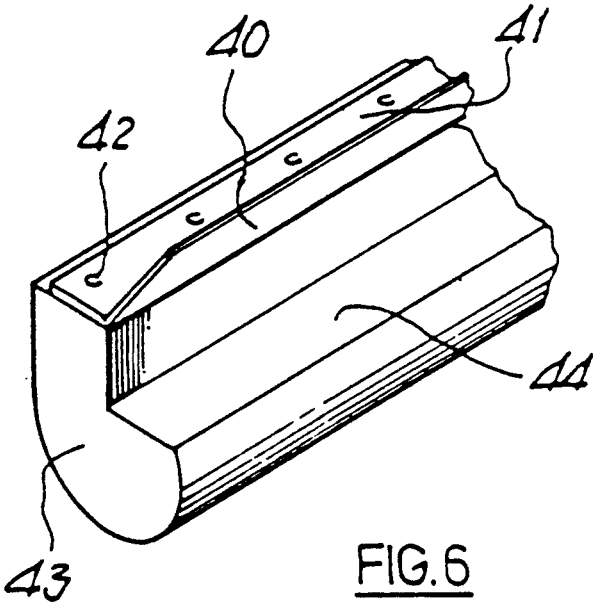
FIG. 6 shows a perspective view of a portion of a side frame member of the third form of frame.

As shown in FIG. 6 in the third form of frame, each flap 40 (or tab) is hingedly connected to a support strip 41 and the support strip is secured to the rear face of the side frame member 43 which may be of wood, for example, adjacent the rebate 44 by pins 42.

The flaps (or tabs) may be formed with their support strips as an integral plastics moulding and are used in the same way as if they were integral with the side frame members.

It will be appreciated that it is not intended to limit the invention to the above example only, many variations, such as might readily occur to one skilled in the art, being possible, without departing from the scope thereof as defined by the appended claims.

I claim:

1. In a rear loaded rectangular picture frame wherein four side members are joined end-to-end and each side member is formed with a rearwardly facing rebate to receive at least one element to be framed, the improvement which comprises (a) the side members each being of unitary plastic material and being joined integrally with one another, (b) at least one resilient flap of the same plastic material as the side members extending integrally from and being hingedly connected to the rear of each of the side members, (c) each of said flaps being movable between a first position in which it lies outside the rebate to allow rear loading of the element to be framed and a second position resiliently biased against the rear of the element after loading to hold said element in place within the rebate, and (d) the flaps on a first pair of opposed side members in said second position latching behind means on the flaps on the second pair of side members to hold the flaps on the second pair of opposed side members against displacement when the flaps on the second pair are first moved into the second position followed by movement into said second position of the flaps on said first pair of side members.

* * * * *